US005799377A

United States Patent [19]

Carroll et al.

[11] Patent Number: 5,799,377

[45] Date of Patent: Sep. 1, 1998

[54] BALLOON NECK CLOSURE AND DECORATION APPARATUS

[75] Inventors: William G. Carroll; James R. Cook, both of Salt Lake City, Utah

[73] Assignee: Maxim, Inc., Salt Lake City, Utah

[21] Appl. No.: 747,598

[22] Filed: Nov. 12, 1996

[51] Int. Cl.[6] ..... B65D 77/10

[52] U.S. Cl. ..... 24/30.5 R; 428/12; 428/66.7; 446/222

[58] Field of Search ..... 24/30.5 R, 30.55; 446/222; 428/12, 66.7

[56] References Cited

U.S. PATENT DOCUMENTS

| | | | |
|---|---|---|---|
| 2,396,906 | 3/1946 | Windson | 446/222 |
| 4,428,149 | 1/1984 | Brown | 446/222 |
| 4,936,532 | 6/1990 | Williams | 446/222 X |
| 5,301,392 | 4/1994 | Richman | 24/30.5 R |
| 5,628,091 | 5/1997 | Mueller | 446/222 X |

*Primary Examiner*—James R. Brittain

*Attorney, Agent, or Firm*—Thorpe North & Western, LLP

[57] ABSTRACT

A balloon decoration enclosure apparatus includes a generally flat closure disk having first, second and third spaced-apart slots, each extending from the perimeter of the disk toward the center thereof, to allow threading the neck of an inflated balloon up through the first slot, over the top of the disk and down through a second slot, and then under the disk and up through the third slot. When so positioned, the inflated balloon extends downwardly of the disk, and the mouth of the balloon extends upwardly a short distance. The disk includes a nipple extending upwardly from near the center of the disk for insertion into a centrally disposed opening of a retainer disk which is pressed down upon the closure disk. A decorative sheet of resilient material is disposed between the closure disk and retainer disk when the retainer disk is in place on the closure disk, so that the material extends upwardly and outwardly from the closure disk and retainer disk in a decorative, generally conical shape. A tie is disposed about the sheet of material to gather the material together at a location just above the retainer disk.

12 Claims, 1 Drawing Sheet

BALLOON NECK CLOSURE AND DECORATION APPARATUS

BACKGROUND OF THE INVENTION

This invention relates to a combination balloon neck closure device and decoration for installation on an inflated balloon to prevent the escape of air and to provide an appealing, ornamental decoration for the balloon.

In recent years, it has become popular to "wrap" a gift by placing it in a transparent inflated balloon and then closing off the balloon neck to prevent the escape of air and maintain the balloon in the inflated condition. This inflated balloon containing the gift can then be presented to a recipient, as one might otherwise do with a conventionally wrapped gift. In this configuration, the inflated balloon with gift may simply be displayed by the recipient with the gift remaining in the balloon, or the gift may be immediately removed.

With such inflated balloons, the neck of the balloon is typically tied by a string or ribbon in a conventional fashion and then possibly other decorative paraphernalia thereafter added to the balloon to provide a more appealing display piece. The inflation, insertion of gift and tying off of the balloons are carried out in various retail establishments by use of balloon inflating machines which operate to hold the neck of the balloon wide open to enable insertion of the gift. After the gift is inserted into the inflated balloon, the balloon neck is then tied off to prevent the escape of air and the inflated balloon with gift is removed from the apparatus.

Typically, the choices available to purchasers of an inflated balloon with gift are limited in the decorative items which may be added to the balloon, since it is difficult to include decorations much beyond the string or ribbons used to tie off the balloon. Any other decorative items would have to be secured to the balloon by an adhesive or tied thereto by string, ribbons or the like. Preparation of the inflated balloon for delivery in the manner described, of course, can be quite time consuming.

SUMMARY OF THE INVENTION

It is an object of the invention to provide a simple to use balloon neck closure and decoration device.

It is a further object of the invention to provide such a device in which a variety of decorative elements may be included with the device.

It is a further object of the invention to provide such a device which may be easily installed on the neck of an inflated balloon to close the neck, and also easily removed therefrom.

The above and other objects of the invention are realized in a specific illustrative embodiment of a balloon neck closure and decoration device which includes a closure disk having a perimeter formed with two or more spaced-apart slots extending inwardly from the perimeter. The slots are for holding the neck of a balloon where the neck is threaded upwardly through one slot, across a portion of the disk, and downwardly through another slot to close off the neck and prevent the escape of air therefrom. A retainer disk is also provided and is attachable to the top of the closure disk. Also included is a resilient sheet of material disposable about the retainer disk to extend upwardly and outwardly therefrom for decorative display when the retainer disk is attached to the closure disk. In this configuration, the decorative sheet of material would extend upwardly from the disks and neck of the balloon, with the inflated balloon extending downwardly from the disks.

In accordance with one aspect of the invention, one or more ribbons are included for wrapping about the sheet of material to gather and close it above the retainer disk.

In accordance with another aspect of the invention, there is included a transparent, tubular sleeve into which the assembled combination of closure disk, retainer disk, and sheet of material may be inserted so that the sheet of material is gathered together in an elongate, compact configuration. The transparent sleeve allows for viewing the device therethrough to allow a purchaser to select a desired color combination and configuration for use on a similarly selected balloon and gift.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
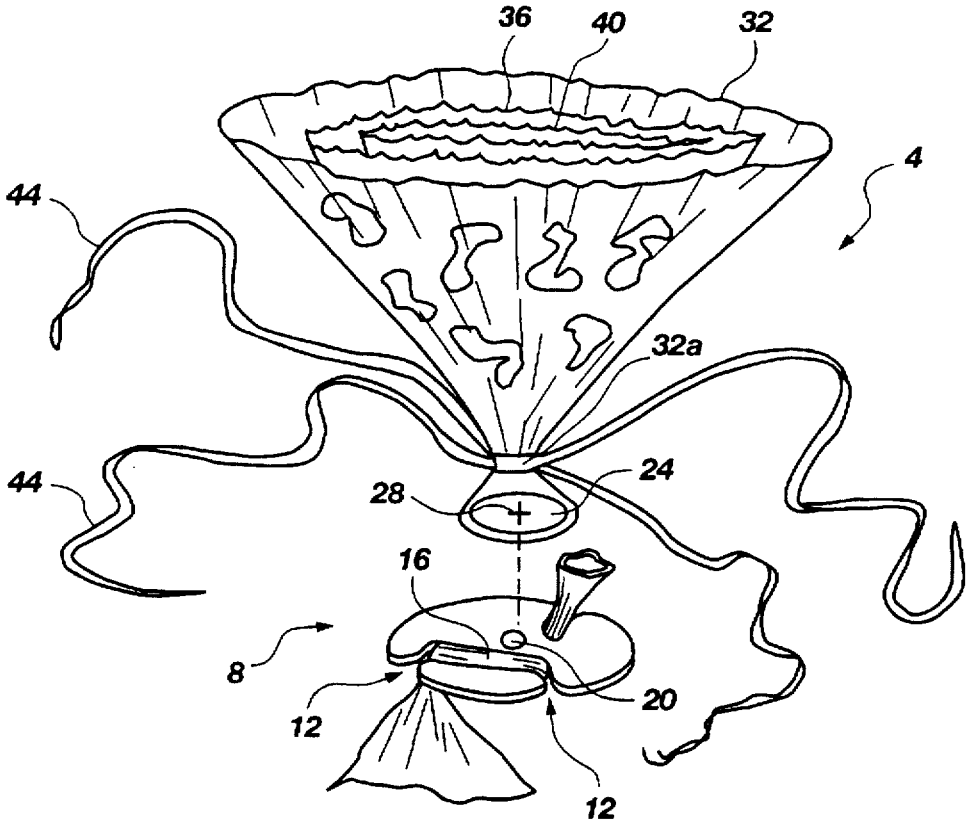
FIG. 1 is a partially exploded, perspective view of a balloon neck closure and decoration device made in accordance with the principles of the present invention.

Referring to the drawings, there is shown the balloon neck closure and decoration apparatus 4 of the present invention, to include a generally circular, flat closure disk 8, having three generally equally spaced-apart slots 12. Each slot 12 extends from the periphery of the disk 8 inwardly toward the center of the disk, with each slot having an opening 12*a* which is wider at the perimeter of the disk than just inside the perimeter, a neck portion 12*b* having generally parallel side walls, and an enlarged terminal end 12*c* (FIG. 2). The closure disk 8 serves to close a balloon neck, such as balloon neck 16, by threading the neck upwardly through a first one of the slots so that the neck resides in the enlarged terminal end, and then across a portion of the top of the closure disk 8, down through another one of the slots, and from there underneath the bottom side of the closure disk and up through the third slot. This is shown in both FIGS. 1 and 2.

Extending upwardly from the center of the closure disk 8 is a nipple 20 whose purpose will be discussed momentarily. The closure disk 8 may be made of any suitable plastic material such as polyethylene, polyurethane, or the like.

The apparatus 4 also includes a retainer button or disk 24, smaller than the closure disk 8, and having a centrally positioned opening 28 in the form of a cross. The retainer disk 24 is made of a resilient plastic so that when the retainer disk is pressed down upon the closure disk, with the opening 28 positioned over the nipple 20, the sides of the opening flex to allow the nipple to be received thereinto, as shown in FIG. 2.

Figure 2:
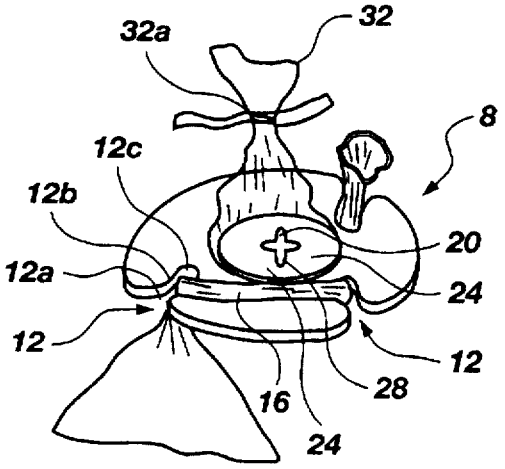
FIG. 2 is a fragmented, perspective view of the assembled device mounted on a balloon neck to close the neck.

Three sheets of resilient material 32, 36 and 40 are nested together and formed into an inverted cone-shape, as shown in FIG. 1, to provide a decorative feature to the device. The retainer disk 24 is disposed in the center of at least the outer sheet of material 32 with the outer sheet of material gathered at a location 32*a* just above the retainer disk 24 so that the remainder of the sheet of material extends upwardly and outwardly in the shape of an inverted cone. The gathering at location 32*a* is maintained by one or more ribbons 44 tied about the location as best seen in FIG. 1. The other sheets of material 36 and 40 may likewise enclose the retainer disk 24 or simply be attached by an adhesive inside the outer sheet of material 32.

The sheets of material may be made of any conventional wrapping paper or foil and may include decorative imprints as desired by the user.

With the retainer disk 24 disposed in and enclosed by the outer sheet of material 32, as shown in FIG. 1, the disk can be pressed down upon the nipple 20 of the closure disk 8 so that the nipple punctures the sheet of material 32 and pushes through the opening 28 of the retainer disk. In this assembled condition, as shown in FIG. 2, the apparatus 4 is ready for installation on the neck of a balloon. When so installed, the inflated balloon extends downwardly from the closure disk 8 and the decorative materials 32, 36 and 40 extend upwardly therefrom, to present an appealing balloon decoration. The neck of the balloon may simply be twisted or held in the gathered condition and inserted in the appropriate slots until it is threaded as shown in FIGS. 1 and 2. This can take place very rapidly and the balloon closure apparatus can be easily removed from the balloon for use again if so desired.

Figure 3:
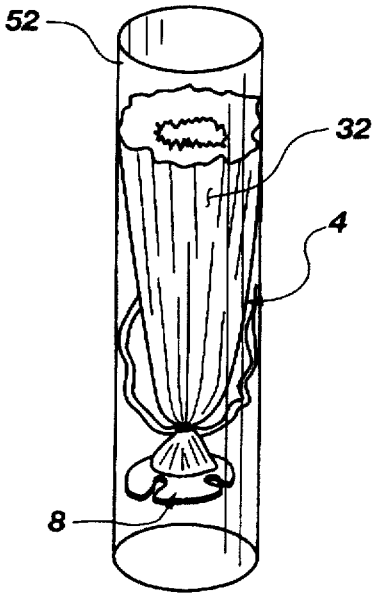
FIG. 3 is a perspective view of the device disposed in a transparent tubular sleeve.

FIG. 3 shows the balloon neck closure and decoration apparatus 4 disposed in a transparent tubular sleeve 52 which is especially desirable for retail display. As can be seen in FIG. 3, the decorative sheets of material are gathered together so that the entire apparatus forms an elongate compact configuration for holding in place by the tubular sleeve 52. For use, the apparatus 4 is simply pulled from the tubular sleeve 52 where the decorative sheets of material 32, 36 and 40 could be spread apart as shown in FIG. 3 and then the apparatus could be installed on a balloon.

What is claimed is:

1. A balloon neck closure and decoration securing device comprising disk means having a perimeter formed with two or more spaced-apart slots extending inwardly from the perimeter, for holding the neck of a balloon threaded upwardly through one slot, across a portion of the disk means, and downwardly through another slot to close off the neck and prevent the escape of gas therefrom, button means, attachable to the top of the disk means, and a resilient sheet of material disposable about the button means to extend upwardly and outwardly therefrom for decorative display when the button means is attached to the disk means, closing off the neck of a balloon.

2. A device as in claim 1 further including a ribbon wrapped about the sheet of material to gather and close it above the button means.

3. A device as in claim 1 wherein said disk means further includes a third slot spaced apart from said two slots for holding the neck of the balloon threaded under a portion of the disk means from said another slot and up through the third slot.

4. A device as in claim 3 wherein each of said slots is formed with an opening at the periphery of the disk means, a channel with generally parallel walls extending from the opening toward the center of the disk means to terminate in an enlarged terminal end.

5. A device as in claim 3 wherein the slots are generally equally spaced apart from one another.

6. A device as in claim 1 wherein said disk means includes a generally upwardly extending nipple, and wherein said button means includes an opening for receiving the nipple to hold the button means attached to the top of the disk means.

7. A device as in claim 6 wherein said opening in the button means is in the shape of a cross.

8. A device as in claim 1 further including a flexible tubular sleeve dimensioned to allow insertion thereinto of the disk means, button means and sheet of material which is gathered to extend upwardly from the disk means and button means.

9. A device as in claim 8 wherein said tubular sleeve is comprised of a transparent material.

10. A balloon decoration and closure apparatus comprising a generally flat closure disk having first, second and third spaced-apart slots, each extending from the perimeter of the disk generally toward the center thereof, to allow threading the neck of an inflated balloon up through the first slot, over a portion of the top of the disk and down through the second slot, and under a portion of the bottom of the disk and up through the third slot, so that the inflated balloon extends downwardly of the disk and the mouth of the balloon on the end of the neck extends upwardly of the disk a short distance, said disk also including a nipple extending upwardly from near the center of the disk, a generally flat retainer disk having a central opening for receiving the nipple of the closure disk to hold the retainer disk in place on the closure disk, a decorative sheet of resilient material disposable between the closure disk and retainer disk when the retainer disk is in place on the closure disk, so that the material extends upwardly from the closure disk and retainer disk in a generally conical shape, and a tie means disposed to gather the material together at a location just above the retainer disk.

11. Apparatus as in claim 10 wherein said tie means is a ribbon.

12. Apparatus as in claim 10 further including a transparent, flexible sleeve for holding the closure disk, retainer disk, tie means and material in an elongate, compact configuration.

* * * * *